US010240761B2

(12) United States Patent
Elmvang

(10) Patent No.: US 10,240,761 B2
(45) Date of Patent: Mar. 26, 2019

(54) LAMP HOUSING WITH A LOCKING DEVICE

(71) Applicant: Fischer Lighting ApS, Vanløse (DK)

(72) Inventor: Stig Elmvang, Skovlunde (DK)

(73) Assignee: Fischer Lighting ApS, Vanløse (DK)

( * ) Notice: Subject to any disclaimer, the term of this patent is extended or adjusted under 35 U.S.C. 154(b) by 0 days.

(21) Appl. No.: 15/761,952

(22) PCT Filed: Sep. 27, 2016

(86) PCT No.: PCT/DK2016/050310
§ 371 (c)(1),
(2) Date: Mar. 21, 2018

(87) PCT Pub. No.: WO2017/054826
PCT Pub. Date: Apr. 6, 2017

(65) Prior Publication Data

US 2018/0266665 A1 Sep. 20, 2018

(30) Foreign Application Priority Data

Sep. 28, 2015 (DK) ..... 2015 70611

(51) Int. Cl.
*F21V 21/04* (2006.01)
*F21S 8/02* (2006.01)

(52) U.S. Cl.
CPC ..... *F21V 21/042* (2013.01); *F21S 8/026* (2013.01)

(58) Field of Classification Search
CPC ..... F21V 21/04; F21V 21/041; F21V 21/042; F21S 8/026; F21S 8/028
USPC ..... 362/137, 138, 364, 365
See application file for complete search history.

(56) References Cited

U.S. PATENT DOCUMENTS 3,620,401 A * 11/1971 Lund ..... F21V 21/04 220/3.6
4,250,540 A * 2/1981 Kristofek ..... F21V 21/04 248/27.1
4,733,339 A * 3/1988 Kelsall ..... F21V 21/04 362/365

(Continued)

FOREIGN PATENT DOCUMENTS

AU 2008249058 B2 8/2013
EP 0840060 A2 5/1998

(Continued)

*Primary Examiner* — Julie A Bannan
(74) *Attorney, Agent, or Firm* — Dinsmore & Shohl LLP

(57) ABSTRACT

A lamp housing inserted into an installation-opening has an outer surface and an inner surface, a slot going through the outer surface into the inner surface, and a locking device connected to the outer surface. The locking device has an elongated member with a protruding part. The protruding part has a bottom and top part with a pushing-surface and a contacting-surface. The elongated member pivots between a first and second position. In the first position, the bottom part is inside the slot, and the top part is inside the housing, whereby the contacting-surface and pushing-surface are inside the housing. In the second position, the bottom part is outside the slot, and the top part is partly inside the slot, whereby the contacting-surface contacts the outer surface and the pushing-surface is between the outer and inner surface, whereby the housing can be wedged in the installation-opening by the elongated member.

26 Claims, 9 Drawing Sheets

(56) References Cited

U.S. PATENT DOCUMENTS

| | | | | | |
|---|---|---|---|---|---|
| 5,314,148 | A * | 5/1994 | Jones | F21V 21/04 | 248/27.3 |
| 5,609,414 | A * | 3/1997 | Caluori | F21S 8/02 | 248/27.1 |
| 5,944,412 | A * | 8/1999 | Janos | F21V 21/04 | 362/148 |
| 6,505,960 | B2 * | 1/2003 | Schubert | F21V 21/04 | 362/147 |
| 6,554,458 | B1 * | 4/2003 | Benghozi | F21V 21/04 | 362/147 |
| 7,530,717 | B2 * | 5/2009 | Magisano | F21V 21/043 | 248/343 |
| 8,465,182 | B1 * | 6/2013 | Davis | F21V 21/042 | 248/342 |
| 2003/0223240 | A1 * | 12/2003 | Houle | F21V 21/04 | 362/364 |
| 2005/0258326 | A1 * | 11/2005 | St-Pierre | F21V 21/04 | 248/316.7 |
| 2016/0069541 | A1 * | 3/2016 | Huang | F21V 23/001 | 362/374 |

FOREIGN PATENT DOCUMENTS

| | | | | |
|---|---|---|---|---|
| EP | 0999409 | A2 | 5/2000 | |
| EP | 1016819 | A1 | 7/2000 | |
| EP | 1936265 | A1 | 6/2008 | |
| EP | 2372237 | A1 | 10/2011 | |
| EP | 2320136 | B1 | 12/2014 | |
| EP | 2314914 | B1 | 2/2015 | |
| FR | 1304849 | A | 9/1962 | |
| WO | 9853248 | A1 | 11/1998 | |
| WO | 2005022033 | A1 | 3/2005 | |
| WO | WO 2007101889 | * | 9/2007 | F21S 8/02 |
| WO | 2014183968 | A1 | 11/2014 | |

* cited by examiner

LAMP HOUSING WITH A LOCKING DEVICE

CROSS-REFERENCE TO RELATED APPLICATIONS

This application is a U.S. National stage of International Application No. PCT/DK2016/050310, which was filed on Sep. 27, 2016 and which claims priority from Danish Application No. PA 2015 70611 filed on Sep. 28, 2015. The entire contents of these applications are incorporated herein by reference in their entirety.

FIELD OF THE INVENTION

The present invention relates to a lamp housing with a locking device, in particular, a locking device that is able to lock the lamp housing in an installation opening. More particular, the present invention relates to a locking device that can be operated with one hand and from within the lamp housing.

BACKGROUND OF THE INVENTION

In typical ceiling-mounted lamp housings, two hands are required to install it in an installation opening, in particular because the locking mechanisms typically are spring-loaded and needs to be operated from outside the lamp housing. When installing ceiling-mounted lamp housings, it is typical that a ladder is needed to stand on. Thus, using two hands while standing on a ladder is a dangerous job.

Further, because the most common locking mechanisms typically are spring-loaded, the force by which the housings are locked with, are dependent on the spring force. To have a strong locking, a strong spring force is needed. However, in order to have a strong locking, it requires that the installer of the lamp housing is able to compress the spring while installing the lamp housing. Spring loaded locking mechanisms and two hands operation installation of lamp housings complicate installation.

Thus, there is a need for improvement in lamp housings with locking mechanisms.

SUMMARY OF THE INVENTION

In order to improve the current state of lamp housing and in order to overcome the problems as above describes, the present disclosure provides a lamp housing to be inserted into an installation-opening. The lamp housing comprises: an outer surface and an inner surface; and a slot going through the outer surface into the inner surface. The lamp housing further comprises in one embodiment; a locking device connected to the outer surface, wherein the locking device comprises: an elongated member; a protruding part from the elongated member, wherein the protruding part, comprises a bottom part; and a top part. In another embodiment the top part comprises a pushing-surface and a contacting-surface, and wherein the elongated member is able to pivot between a first position and a second position such that: in the first position, the elongated member is positioned such that the bottom part is inside the slot, and such that the top part is inside the housing, whereby the contacting-surface and the pushing-surface are inside the lamp housing. In yet another embodiment, in the second position, the elongated member is positioned such that the bottom part is outside the slot, and such that the top part is partly inside the slot, whereby the contacting-surface is contacting the outer surface and the pushing-surface is between inside of the housing and the outer surface, whereby the lamp housing is able to be wedged in the installation-opening by the elongated member.

A first advantage of the present invention is related to the pushing surface is inside the lamp housing. By this feature, it is possible to push the pushing-surface from within the lamp housing, thereby installing the lamp housing in an installation opening by a simple click, for example using one finger. By the present invention, it is possible to hold the lamp housing with one, using for example all five fingers, then to press-fit the lamp housing into the installation hole, move one of the five fingers to the pushing-surface, whereby the lamp housing is installed with one hand and one click. Thus, the present invention provides a lamp housing that it easily installed in an installation-hole, for example in a ceiling or a wall. The locking device as defined by the present invention does not require being spring loaded, in particular because the contacting-surface is contacting the outer surface in the second position.

An advantage of having the pushing-surface between the inside of the housing and the outer surface in the second position is that this may allow for lamp or a main body that holds a lamp to slide and/or rotate along the inner surface.

DETAILED DESCRIPTION OF THE INVENTION

Locking Device

Figure 1:
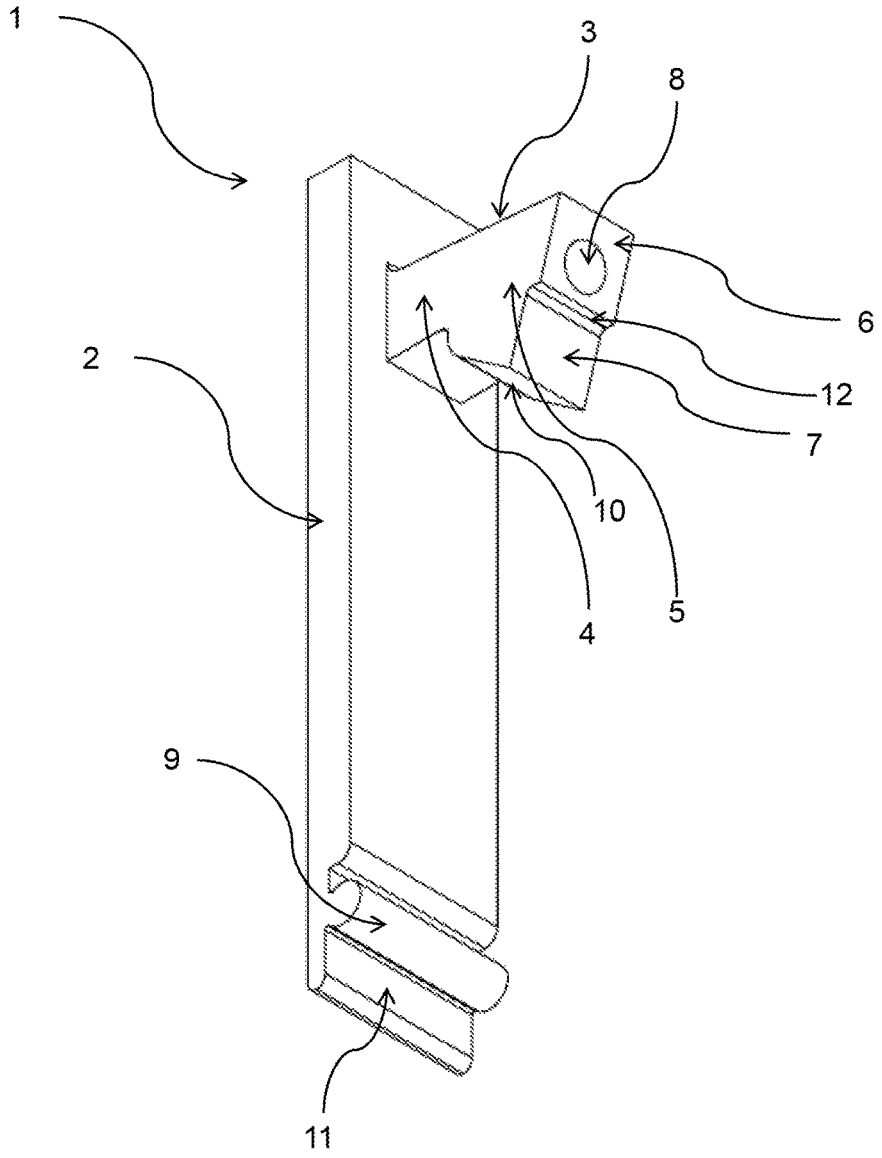
FIG. 1 shows an embodiment of the locking device according to the present invention from a perspective.

As previously described, the locking device may in one embodiment of the present invention be a non-spring-loaded locking device.

In another embodiment of the present invention, the locking device is formed as a pawl. A pawl or a locking pawl is generally known for being used in connection with a toothed wheel. However, the effect of a pawl is that is by it shape stops or locks or releases a mechanism. The pawl, generally the locking device, as herein disclosed locks the locking device itself into the slot in the second position when the locking pawl is pushed via the pushing-surface from the first position to the second position, at least when being placed in the installation-opening. In one embodiment, it is the installation-opening that prevents the locking pawl from going further away from the outer surface.

As just described, the locking device may be non-spring loaded, and therefore, when not being placed in an installation-opening, the locking device may not be prevented from going further away from the outer surface, i.e. the contacting-surface may not be prevented from leaving the outer surface.

However, in some embodiments, the locking device may be prevented from going further away from the outer surface, i.e. the contacting-surface may be prevented from leaving the outer surface, see further details related to locking in the section "elongated member", in "first position" and in "second position".

Pushing-Surface and Contacting Surface

In one embodiment of the present invention, the pushing-surface and the contacting surface have an area that is identical to and/or smaller than an area of the slot. By such construction, it is possible to have both surfaces to pass the slot from the first position to the second position, in particular in an embodiment when the pushing-surface and the contacting-surface are parallel.

In another embodiment, the pushing-surface and the contacting-surface are separated by a distance that is identical to the distance between the outer surface and the inner surface. For example, in an embodiment when the pushing-surface and the contacting-surface are parallel, the distance between the pushing-surface and the contacting-surface may be on a connecting-surface that connects the pushing-surface and the contacting-surface, whereby a pawl is formed by the pushing-surface, the connecting-surface and the contacting-surface. The connecting surface engages with the slot, in particular the connecting-surface engages with a rim of the slot. By having the pushing-surface and the contacting-surface separated by a distance that is identical to the distance between the outer surface and the inner surface, the pushing-surface is able to be placed between the outer surface and the inner surface in the second position, in this case, the pushing-surface is able to coincide with the inner surface.

In a preferred embodiment of the present invention, the pushing surface is configured for being pushed on from inside of the lamp housing, such that the elongated locking device is able to pivot between the first position and the second position. This may facilitate easy installation of the lamp housing in the installation-opening.

In a more preferred embodiment of the present invention, the pushing surface is configured with extension means, such that the pushing-surface can be extended with an extension part such that in the second position, the extension part is inside the lamp housing. Having the extension part on the pushing-surface clearly also means that in the first position, the extension part is also in the lamp housing. The extension means may be a screw or a threading hole for a screw, such that the extension part is configured to fit with the extension means. Having the extension part on the pushing surface extends the pushing-surface, whereby a larger torque is able to be applied such that the elongated member is able to be wedged between the lamp housing and the installation-opening. After the lamp housing has been installed in the installation-opening using the extension part, it is possible to detach the extension part, such that the inner surface has no parts that block for lamps or main bodies being installed in the lamp housing.

In a most preferred embodiment of the present invention, a cross-section of the bottom part has an area that is smaller than a total area of the pushing-surface and the contacting-surface. This may for example facilitate that the elongated member stays in the first position until it is pushed to the second position, at least when the pushing-surface and the contacting-surface are parallel and/or when the contacting-surface in the first position is placed such that it is not able to go directly through the slot.

Elongated Member

In one embodiment of the present invention, the elongated member and the protruding part are made as a single component. Alternatively, the elongated member and the protruding part may be two separate components that are attached to each other.

In another embodiment of the present invention, the elongated member is made of a flexible material, such as plastic or metal or a combination thereof. In the embodiment, where the elongated member is made of metal, it is to be understood that a flexible material may be achieved by having proper dimensions of the elongated material, such as for example being thinner than longer. This is elaborated in further details below.

It is preferred that the length of the elongated member is between 50 mm and 200 mm, preferably between 50 and 70 mm, whilst the thickness of the elongated member is between 1 mm and 5 mm, preferably between 3 and 4 mm, meaning a ratio between length and thickness being between 10 and 50, and preferably between 16 and 20. It has been found that such a ratio provides flexibility so that the elongated member is able to be posited from the first position to the second position by a bending of the elongated member. The width of the elongated member may be between 5 mm and 100 mm.

In some embodiments of the present invention, the protruding member may be between 2 and 10 mm wide, such as between 5 and 7 mm wide, such as 6 mm wide. Accordingly, the slot may be between 2 and 10 mm wide, such as between 5 and 7 mm wide, such as 6 mm wide.

In some embodiments of the present invention, the elongated member is wider than the protruding part. This may for example facilitate that a large pressure is able to be transferred to the side of the installation-hole. The width of the elongated member may for example be between 4 and 20 mm, such as between 10 and 14 mm, such as 12 mm.

Attachment Means

In a preferred embodiment, the elongated locking device further comprising attachment means defining the pivot axis, wherein the attachment means is configured for being attached to a fastening means on the outer surface. The attachment means may be a click-on attachment, such as a circular part, the circular part having a radius of curvature between 1 and 2 mm, such as around 1.5 mm.

Wedge Angle

In a preferred embodiment, a shortest distance from the pivot axis to the contacting-surface and a shortest distance from the elongated member to the contacting-surface defines a wedge angle, such that the lamp housing is able to be wedged in the installation-opening by the elongated member.

In a more preferred embodiment, the contacting surface is angled relative to the elongated member with an angle given by the wedge angle. Thus, when the contacting-surface is in contact with the part of the outer surface in the second position, the contacting-surface is in contact with the outer surface, providing a stable locking of the elongated member.

In a most preferred embodiment, the wedge angle is between 5 and 35 degrees, such as between 10 and 25 degrees, or such as between 15 and 17 degrees.

First Position

According to the present invention, it may be such that in the first position, the lamp housing is able to be inserted in the installation-opening.

Further, in one embodiment, it is such that in the first position, the contacting-surface is prevented from going through the slot from the inner surface to the outer surface by having a back side of the contacting-surface facing the inner surface. In other words, the protruding part may comprise a second protruding part, protruding from the protruding part, preferably towards the pivot axis. In relation hereto, the contacting-surface may be able to go through the slot from the inner surface to the outer surface due to the backside being angled relative to the contacting surface. For example, this may be possible due to pressure being applied to the pushing-surface. Alternative, and/or additionally, the contacting-surface may be able to go through the slot from the inner surface to the outer surface due the locking device being flexible.

Second Position

Preferably, in the second position, the pushing-surface may be between the inner surface and the outer surface. This may provide that no parts are inside the housing whilst in the second position, such that lamps or main units that hold a lamp can be freely installed in the lamp housing.

According to the present invention, it may be such that in the second position, the lamp housing is able to be locked in the installation-opening due to pressure applied from the elongated member to a side of the installation-opening. Since the lamp housing is wedged, there may both be pressure applied to the side of the lamp housing and from above the installation-opening. Thus, alternatively and/or additionally, it may be such that in the second position, the lamp housing is able to be locked in the installation-opening due to pressure applied from the elongated member to an inner part of the installation-opening. The inner part may for example be the backside of a ceiling, i.e. the loft.

Further, in the second position, the contacting-surface may be prevented from going through the slot from the outer surface to the inner surface by having a front side of the contacting-surface matching the outer surface. For example, by at least having the contacting surface angled relative to the elongated member with an angle given by the wedge angle, as previously described.

In one embodiment of the present invention, in the second position, and when not in an installation hole, the contacting-surface is not prevented from leaving the outer surface.

Alternatively, in the second position, and when not in an installation hole, the contacting-surface is prevented from leaving the outer surface by having a part of the elongated member below the pivot axis, wherein the part of the elongated member below the pivot axis is thinner than a part of the elongated member above the pivot point. The part of the elongated member above the pivot axis may for example be between 1.5 and 2 mm.

Lamp Housing

In one embodiment of the present invention, the part of the outer surface is a part that extends around one or more sides of the slot. In this embodiment, the part that extends around one or more sides of the slot may facilitate that the elongated member, specifically the protruding part, is properly maintained in the first position during installation in the hole. In this way, it is facilitated that the pushing surface is also maintained inside the lamp housing, such that it is secured that the elongated member is in its place, i.e. its first position, and can be shifted to the second position.

In an alternative embodiment of the present invention, the part of the outer surface is a part that is recessed around one or more sides of the slot. In this embodiment, it may be possible to have the elongated member positioned substantially parallel to the outer surface, for example if the outer surface is partly cylindrical. The elongated member may be able to fit into part that is recessed around one or more sides of the slot. Thus, if the lamp housing is cylindrical, the recessed part may facilitate that the lamp housing is able to be inserted into the installation-opening. In this embodiment, the elongated member may be flush with the outer surface such that the dimensions defined by the outer surface, defines the installation opening.

In one embodiment of the present invention, the lamp housing further comprises a flange extending radially from the outer surface. The lamp housing may then in the second position be maintained between the elongated member and the flange.

In some embodiments, the inner surface is configured for holding a lamp or for holding a main body that holds a lamp. Preferably, the inner surface or at least part of the inner surface is curved such as like a parabola. Having a curved surface, such as a parabola may facilitate that light from a lamp is emitted from the lamp into the parabola, where it may be reflected, and further be emitted out of the lamp housing such that light leaving the light house forms a single directional beam.

In further embodiments, the lamp housing comprises a top part adapted with a hole. The hole may be for wiring to a lamp or to a main body that holds a lamp.

In a preferred embodiment, there are two or more slots and a locking device as herein described for each of the slots.

EXAMPLE 1

Locking Device

With reference to FIG. 1, there is shown an embodiment of the locking device according to the present invention. According to the present invention, the locking device 1 comprises: an elongated member 2; a protruding part 3 from the elongated member 2, wherein the protruding part 3, comprises a bottom part 4; and a top part 5, wherein the top part comprises a pushing-surface 6 and a contacting-surface 7. The pushing-surface 6 is configured with extension means 8, here shown as a threaded hole, such that the pushing surface 6 can be extended with an extension part. The elongated locking device 1 further comprises attachment means defining the pivot axis 9. Further, there is a back side 10 of the contacting-surface 7, the backside being angled relative to the contacting surface 7. As also shown in this figure, there is a part 11 of the elongated member 2 below the pivot axis 9, wherein the part 11 of the elongated member 2 below the pivot axis 9 is thinner than a part of the elongated member 2 above the pivot point 9. The locking device 1 is formed as a pawl, in that the pushing-surface 6 and the contacting-surface 7 are parallel and the pushing-surface 6 and the contacting-surface 7 are separated by a distance 12 that is identical to the distance between the outer surface and the inner surface of the lamp housing. As can also be seen, a cross-section of the bottom part 4 has an area that is smaller than a total area of the pushing-surface 6 and the contacting-surface 7. Also, the elongated member 2 is wider than the protruding part 3.

EXAMPLE 2

Locking Device (Further Details)

Figure 2:
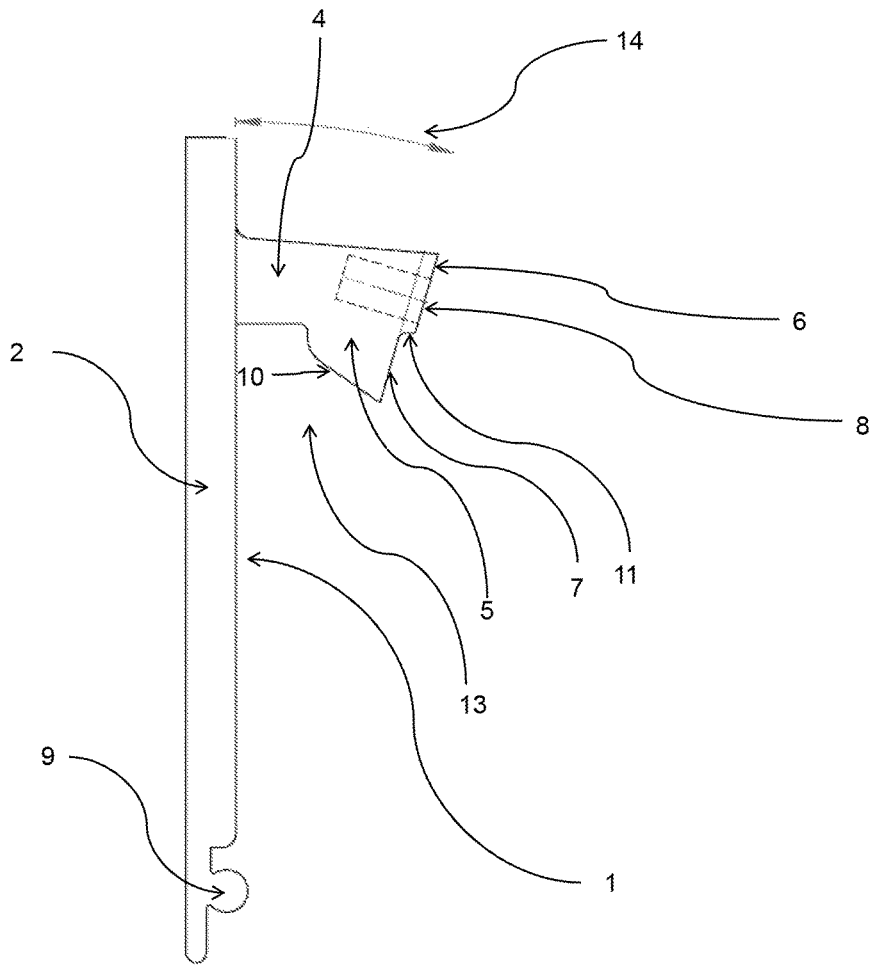
FIG. 2 shows an embodiment of the locking device according to the present invention from a side view.

With reference to FIG. 2, there is shown an embodiment of the locking device according to the present invention. According to the present invention, the locking device 1 comprises: an elongated member 2; a protruding part 3 from the elongated member 2, wherein the protruding part 3, comprises a bottom part 4; and a top part 5, wherein the top part comprises a pushing-surface 6 and a contacting-surface 7. The pushing-surface 6 is configured with extension means 8, here shown as a threaded hole, such that the pushing surface 6 can be extended with an extension part. The elongated locking device 1 further comprises attachment means 9 defining the pivot axis. Further, there is a back side 10 of the contacting-surface 7, the backside being angled relative to the contacting surface 7. As also shown in this figure, there is a part 11 of the elongated member 2 below the pivot axis 9, wherein the part 11 of the elongated member 2 below the pivot axis 9 is thinner than a part of the elongated member above the pivot point 9. The locking device 1 is formed as a pawl, in that the pushing-surface 6 and the contacting-surface 7 are parallel and the pushing-surface 6 and the contacting-surface 7 are separated by a distance 12 that is identical to the distance between the outer surface and the inner surface of a lamp housing. As can also be seen in this figure, a shortest distance from the pivot axis to the contacting-surface and a shortest distance 13 from the elongated member 2 to the contacting-surface 7, defines a wedge angle 14, such that the lamp housing is able to be wedged in the installation-opening by the elongated member.

EXAMPLE 3

Locking Device (Further Details)

Figure 3:
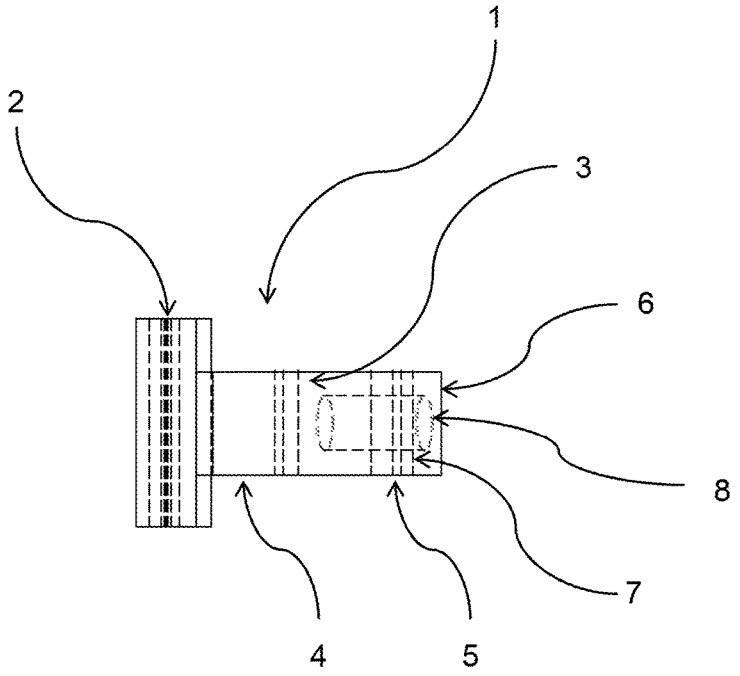
FIG. 3 shows an embodiment of the locking device according to the present invention from a top view.

With reference to FIG. 3, there is shown an embodiment of the locking device according to the present invention from a top view. From this view, it can be seen that the elongated member 2 is wider than the protruding part 3.

EXAMPLE 4

Lamp Housing

Figure 4:
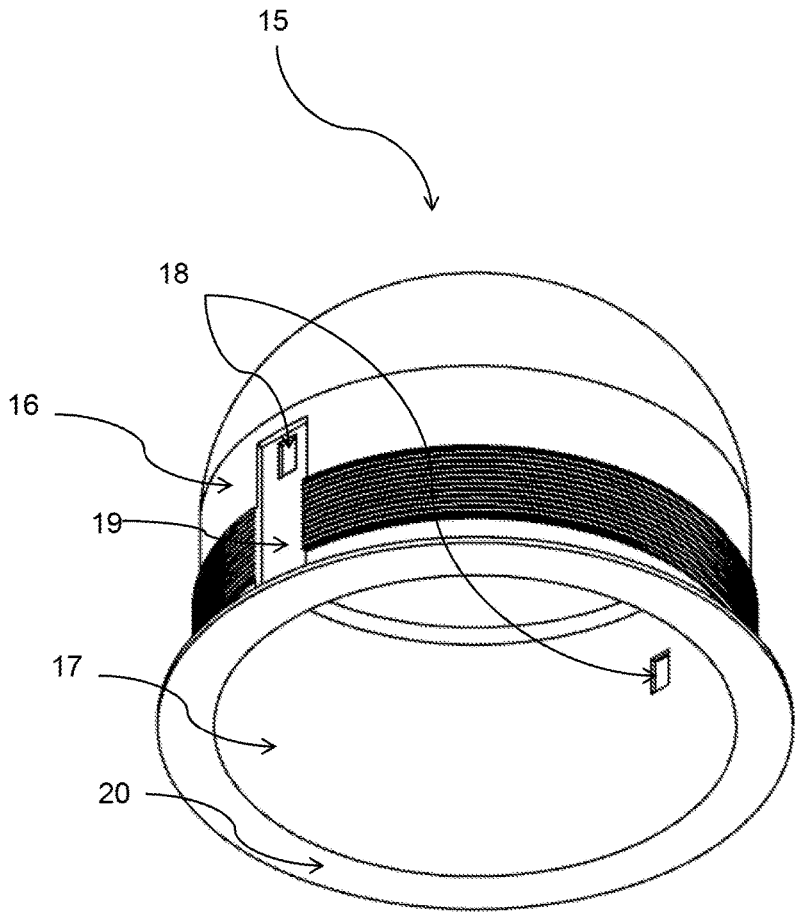
FIG. 4 shows an embodiment of the lamp housing according to the present invention from a perspective.

With reference to FIG. 4, there is shown an embodiment of the lamp housing 15 according to the present invention from a perspective, comprising an outer surface 16 and an inner surface 17; a first slot 18 going through the outer surface 16 into the inner surface 17. Another slot 18 configured as the first slot is also shown. Part 19 of the outer surface 16 has a part that is recessed around all the sides of the slot 18, wherein the elongated member is able to be in the first position. The lamp housing 15 further comprises a flange 20 extending radially from the outer surface 16.

EXAMPLE 5

Lamp Housing (Further Details)

Figure 5:
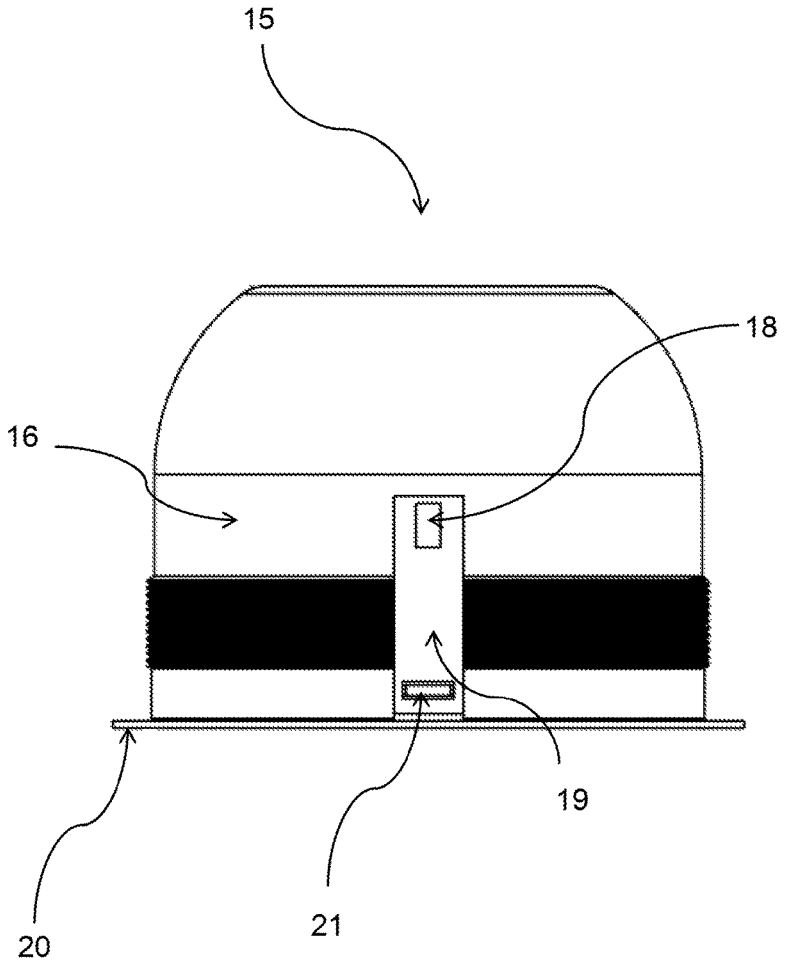
FIG. 5 shows an embodiment of the lamp housing according to the present invention from a side view.

With reference to FIG. 5, there is shown an embodiment of the lamp housing 15 according to the present invention from a side view, comprising an outer surface 16 and an inner surface 17 (not to be seen from this view); a first slot 18 going through the outer surface 16 into the inner surface 17. Part 19 of the outer surface 16 has a part that is recessed around all the sides of the slot 18, wherein the elongated member is able to be in the first position. The lamp housing 15 further comprises a flange 20 extending radially from the outer surface 16. From this view, fastening means 21 are on the outer surface, such that attachment means 9 on the elongated member can be connected to the outer surface 16.

EXAMPLE 6

Lamp Housing with Locking Device (Assembled and Installed in an Installation-Opening)

Figure 6:
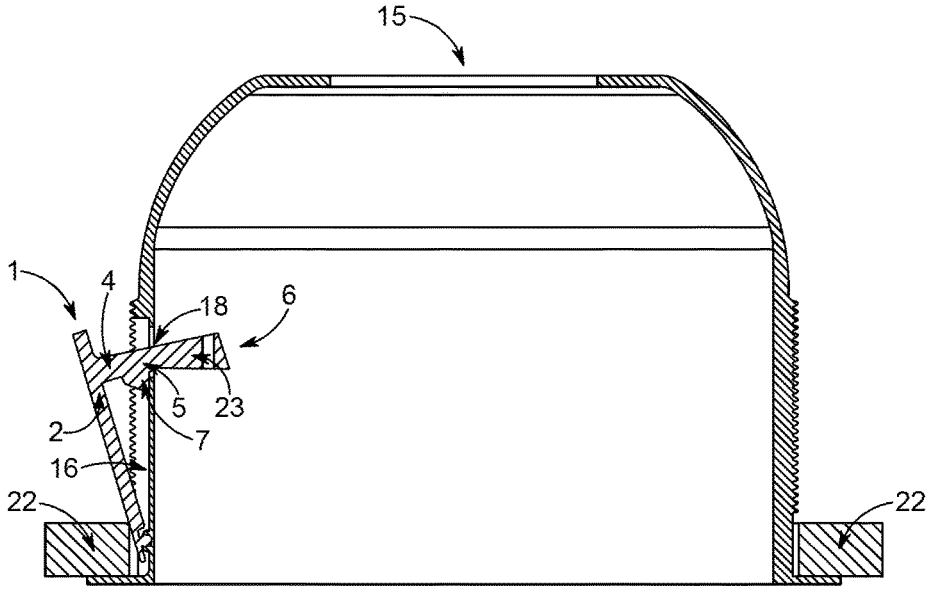
FIG. 6 shows an embodiment of the lamp housing with the locking device according to the present invention from a side view.

With reference to FIG. 6, there is shown a lamp housing 15 with a locking device 1 according to the present invention from a side view. The lamp 15 housing is installed in an installation-opening 22. The locking device is shown in its second position, where the elongated member 2 is positioned with an angle relative to the outer surface 16 of the lamp housing 15, such that the bottom part 4 is outside the slot 18, and such that the top part 5 is partly inside the slot, whereby the contacting-surface 7 is contacting the outer surface 16 and the pushing-surface 6 is between the inside of the housing and the outer surface 16, whereby the lamp housing 15 is able to be wedged in the installation-opening 22 by the elongated member 2. In this embodiment, the pushing surface is extended with an extension part 23 such that in the second position, the extension part 23 is inside the lamp housing.

EXAMPLE 7

Lamp Housing

Figure 7:
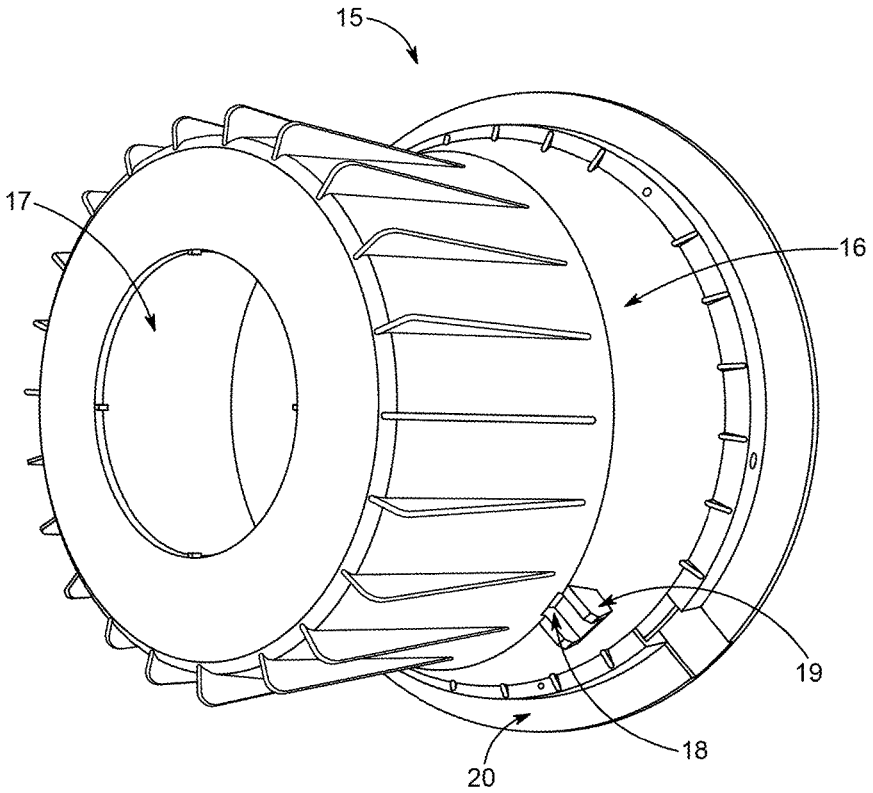
FIG. 7 shows another embodiment of the lamp housing according to the present invention from a first perspective.

With reference to FIG. 7, there is shown another embodiment of the lamp housing 15 according to the present invention from a first perspective, comprising an outer surface 16 and an inner surface 17; a first slot 18 going through the outer surface 16 into the inner surface 17. The inner surface can be seen through a hole which is formed in the top part of the housing. Part of the outer surface 19 has a part that extends around three sides of the slot 18, wherein the elongated member is able to be in the first position. The lamp housing 15 further comprises a flange 20 extending radially from the outer surface 16.

EXAMPLE 8

Lamp Housing

Figure 8:
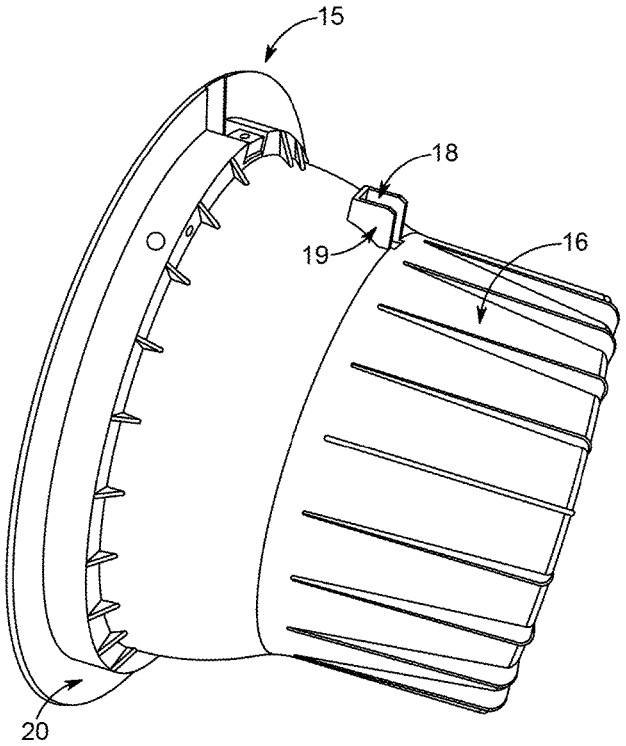
FIG. 8 shows another embodiment of the lamp housing according to the present invention from a second perspective.

With reference to FIG. 8, there is shown another embodiment of the lamp housing 15 according to the present invention from a first perspective, comprising an outer surface 16 and an inner surface 17 (not to be seen from this perspective); a first slot 18 going through the outer surface 16 into the inner surface 17. Part of the outer surface 19 has a part that extends around three sides of the slot 18, wherein the elongated member is able to be in the first position. The lamp housing 15 further comprises a flange 20 extending radially from the outer surface 16.

EXAMPLE 9

Lamp Housing

Figure 9:
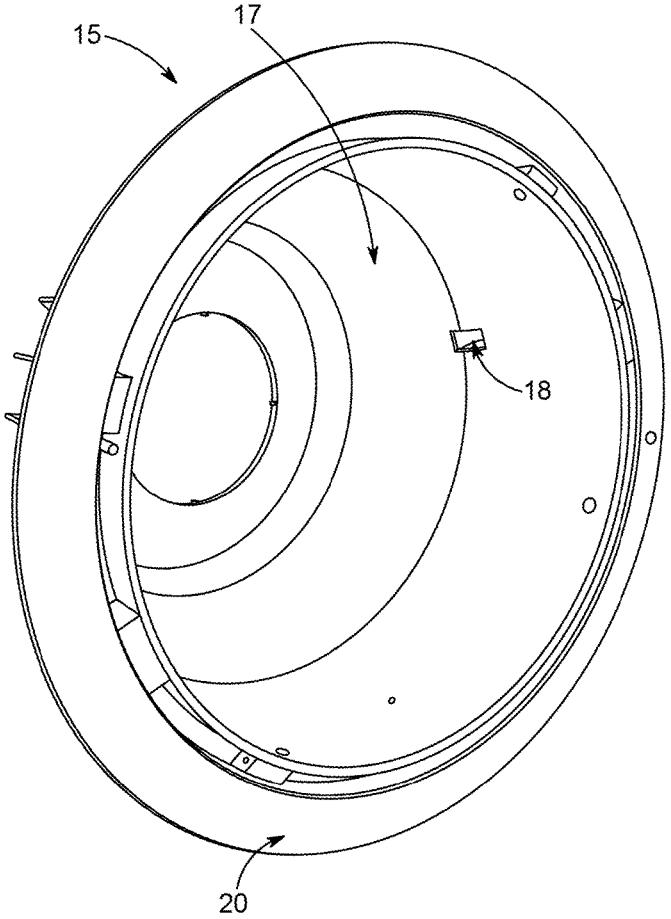
FIG. 9 shows another embodiment of the lamp housing according to the present invention from a second perspective.

With reference to FIG. 9, there is shown another embodiment of the lamp housing 15 according to the present invention from a first perspective, comprising an outer surface 16 (not to be seen from this perspective) and an inner surface 17; a first slot 18 going through the outer surface 16 into the inner surface 17. The lamp housing 15 further comprises a flange 20 extending radially from the outer surface 16. In this embodiment, part of the inner surface 17 is curved like a parabola.

The invention claimed is:

1. A lamp housing to be inserted into an installation-opening, comprising:

an outer surface and an inner surface;

a slot going through the outer surface into the inner surface;

a locking device connected to the outer surface, wherein the locking device comprises:

an elongated member comprising a lower part below a pivot axis which is thinner than an upper part above said pivot axis;

a protruding part protruding from the elongated member, wherein the protruding part, comprises a bottom part; and a top part, wherein the top part comprises a pushing-surface and a contacting-surface, and wherein the elongated member is able to pivot on the pivot axis between a first position and a second position such that:

in the first position, the elongated member is positioned such that the bottom part is inside the slot, and such that the top part is inside the housing, whereby the contacting-surface and the pushing-surface are inside the lamp housing;

in the second position, the elongated member is positioned such that the bottom part is outside the slot, and such that the top part is partly inside the slot, whereby the contacting-surface is contacting a part of the outer surface and the pushing-surface is between the inside of the housing and the outer surface, whereby the lamp housing is able to be wedged in the installation-opening by the elongated member.

2. The lamp housing according to claim 1, wherein the locking device is a non-spring-loaded locking device.

3. The lamp housing according to claim 1, wherein the locking device is formed as a pawl.

4. The lamp housing according to claim 1, wherein the pushing-surface and the contacting surface have an area that is identical to or smaller than an area of the slot.

5. The lamp housing according to claim 1, wherein the pushing-surface and the contacting-surface are parallel.

6. The lamp housing according to claim 1, wherein the part of the outer surface is a part that extends around at least one side of the slot.

7. The lamp housing according to claim 1, wherein the part of the outer surface is a part that is recessed around at least one side of the slot.

8. The lamp housing according to claim 1, wherein the pushing-surface and the contacting-surface are separated by a distance that is identical to the distance between the part of the outer surface and the inner surface.

9. The lamp housing according to claim 1, wherein the pushing-surface is configured for being pushed on from inside of the lamp housing, such that the elongated locking device is able to pivot between the first position and the second position.

10. The lamp housing according to claim 1, wherein the pushing surface is configured with extension means, such that the pushing surface can be extended with an extension part such that in the second position, the extension part is inside the lamp housing.

11. The lamp housing according to claim 1, wherein a cross-section of the bottom part has an area that is smaller than a total area of the pushing-surface and the contacting-surface.

12. The lamp housing according to claim 1, the elongated member further comprising attachment means defining the pivot axis, wherein the attachment means is configured for being attached to a fastening means on the outer surface.

13. The lamp housing according to claim 1, wherein a shortest distance from the pivot axis to the contacting-surface and a shortest distance from the elongated member to the contacting-surface defines a wedge angle, such that the lamp housing is able to be wedged in the installation-opening by the elongated member.

14. The lamp housing according to claim 13, wherein the wedge angle is between 5 and 35 degrees, or between 10 and 25 degrees, or between 15 and 17 degrees.

15. The lamp housing according to claim 1, wherein the elongated member and the protruding part are made as a single component.

16. The lamp housing according to claim 1, wherein the elongated member is made of a flexible material.

17. The lamp housing according to claim 1, wherein the elongated member is wider than the protruding part.

18. The lamp housing according to claim 1, wherein the lamp housing further comprising a flange extending radially from the outer surface.

19. The lamp housing according to claim 1, wherein the inner surface is configured for holding a lamp or for holding a main body that holds a lamp.

20. The lamp housing according to claim 1, wherein in the first position, the lamp housing is capable of being inserted in the installation-opening.

21. The lamp housing according to claim 1, wherein in the first position, the contacting-surface is prevented from going through the slot from the inner surface to the outer surface by having a back side of the contacting-surface facing the inner surface.

22. The lamp housing according to claim 21, wherein the contacting-surface is able to go through the slot from the inner surface to the outer surface due to the backside being angled relative to the contacting surface.

23. The lamp housing according to claim 21, wherein the contacting-surface is able to go through the slot from the inner surface to the outer surface due the locking device being flexible.

24. The lam housing according to claim 1, wherein the pushing-surface is between the inner surface and the outer surface in said second position.

25. The lamp housing according to claim 1, wherein, in the second position, the lamp housing is able to be locked in the installation-opening due to pressure applied from the elongated member to a side of the installation-opening.

26. The lamp housing according to claim 1, wherein, in the second position, the lamp housing is able to be locked in the installation-opening due to pressure applied from the elongated member to an inner part of the installation-opening.

* * * * *